US011585564B2

(12) United States Patent
Jezik et al.

(10) Patent No.: US 11,585,564 B2
(45) Date of Patent: Feb. 21, 2023

(54) BLAST GATES

(71) Applicants: Robert M Jezik, Putnam Valley, NY (US); Susan Jezik, Putnam Valley, NY (US)

(72) Inventors: Robert M Jezik, Putnam Valley, NY (US); Susan Jezik, Putnam Valley, NY (US)

( * ) Notice: Subject to any disclaimer, the term of this patent is extended or adjusted under 35 U.S.C. 154(b) by 237 days.

(21) Appl. No.: 16/845,882

(22) Filed: Apr. 10, 2020

(65) Prior Publication Data

US 2020/0326097 A1 Oct. 15, 2020

Related U.S. Application Data

(60) Provisional application No. 62/920,040, filed on Apr. 10, 2019.

(51) Int. Cl.
*F24F 13/12* (2006.01)

(52) U.S. Cl.
CPC ..... *F24F 13/12* (2013.01)

(58) Field of Classification Search
CPC ..... F24F 13/12; F24F 13/10; Y10S 165/523; F16K 5/0631; F16K 5/0626; F16B 2/00; F16B 5/00; F16B 5/06; F16B 5/0068; F16B 7/0473; F16B 2200/50
USPC ..... 454/324, 361
See application file for complete search history.

(56) References Cited

U.S. PATENT DOCUMENTS 4,760,773 A * 8/1988 Pezzulli ..... F24F 13/00 454/348
6,010,115 A * 1/2000 Schlegel ..... F16K 3/0281 251/327
6,422,535 B1 * 7/2002 Stone ..... F16K 3/0227 251/327
7,398,675 B1 * 7/2008 Metzger ..... F16L 55/105 73/40

* cited by examiner

*Primary Examiner* — Avinash A Savani
*Assistant Examiner* — Ryan L Faulkner
(74) *Attorney, Agent, or Firm* — Leason Ellis LLP

(57) ABSTRACT

An air tight sealing cuff for a blast gate includes a pair of flat plates disposed on opposite sides of the slide mounting of the gate, and replaceable spring clips for holding the plates in position. Resilient gasket material applied to the plates forms a substantially air-tight seal between the slider and slide mount of the cuff and the exterior of the cuff. As a consequence, there is eliminated inadvertent leakage from the area around the gate slider, which would otherwise represent wasted energy. Improved efficiency and reduced carbon footprint result.

12 Claims, 13 Drawing Sheets

BLAST GATES

CROSS REFERENCES TO RELATED APPLICATION

The present application claims the benefit of and priority to U.S. patent application Ser. No. 62/920,040, filed Apr. 10, 2019, which is hereby expressly incorporated by reference in its entirety.

TECHNICAL FIELD

The present invention relates generally to both commercial and industrial ventilation systems, and more particularly to installations incorporating one or more devices known in the trade as blast gates. A blast gate is a device installed at predetermined locations in line with ductwork supplying hot or cold air flow, for providing straight volume control or alternately balancing flow in a desired branchwork of a larger ductwork system.

BACKGROUND

With blast gate equipment such as that described, in particular those utilizing sliders or dampers in series with the air flow, serious leakage can be encountered, especially at the area around the slider. Coupled with the necessity for providing adjustability in the field, such slide components are purposely fabricated to fit loosely in place, while still being held captive. As a result, air leakage takes place, such occurring regardless of whether the air stream being controlled is positive or negative pressure, and also hot or cold.

In summary the inadvertent leakage of such air represents energy losses, namely a portion of a heat generator or a compressor used at the source of the air. Cost of operation is increased, and a larger than acceptable carbon footprint results. Up to the present time, attempts to control such losses have not proven successful in the marketplace.

There has not, to date, been an effective solution for addressing the problems noted above.

SUMMARY

Accordingly, the drawbacks and disadvantages of prior blast gate installations are effectively overcome by the present invention which has for one object to provide a novel and improved blast gate-mounted accessory that is simple in its structure and cost-effective in its fabrication.

A related object is to provide an improved blast gate-mounted accessory in accordance with the foregoing, which is adaptable to different gates in the field, and capable of being removed or substituted between units while without special tools or equipment.

A still further object of the invention is to provide an improved blast gate-mounted accessory as outlined above, which reduces cost by providing improved efficiency of an existing air distribution network, and thereby reducing the overall carbon footprint of the network.

The above objects are accomplished by a leak-resistant accessory for use with a blast gate device of a type having a blast gate housing with substantially cylindrical input and output ports. The ports are adapted to be series connected in line with a section of an air duct system and the blast gate housing also includes a slide mount having an internal peripheral groove in which a slider is movably carried between the ports. The accessory comprises in combination an exterior cuff comprising a pair of coextensive flat plates overlying opposite faces respectively, of the blast housing's slide mount, resilient, compressible gasket material disposed between peripheral and central portions of said flat plates. The gasket material forms a substantially air-tight seal between the slider and slide mount of the cuff and the exterior of the cuff, and a manually operable adjustment for exerting binding force between said slider and coextensive flat plates, whereby relative inadvertent movement of the slider inside the cuff is prevented.

Other features and advantages will hereinafter appear.

BRIEF DESCRIPTION OF THE DRAWING FIGURES

In the accompanying drawings illustrating one embodiment of the invention:

DETAILED DESCRIPTION OF CERTAIN EMBODIMENTS

Figure 11:
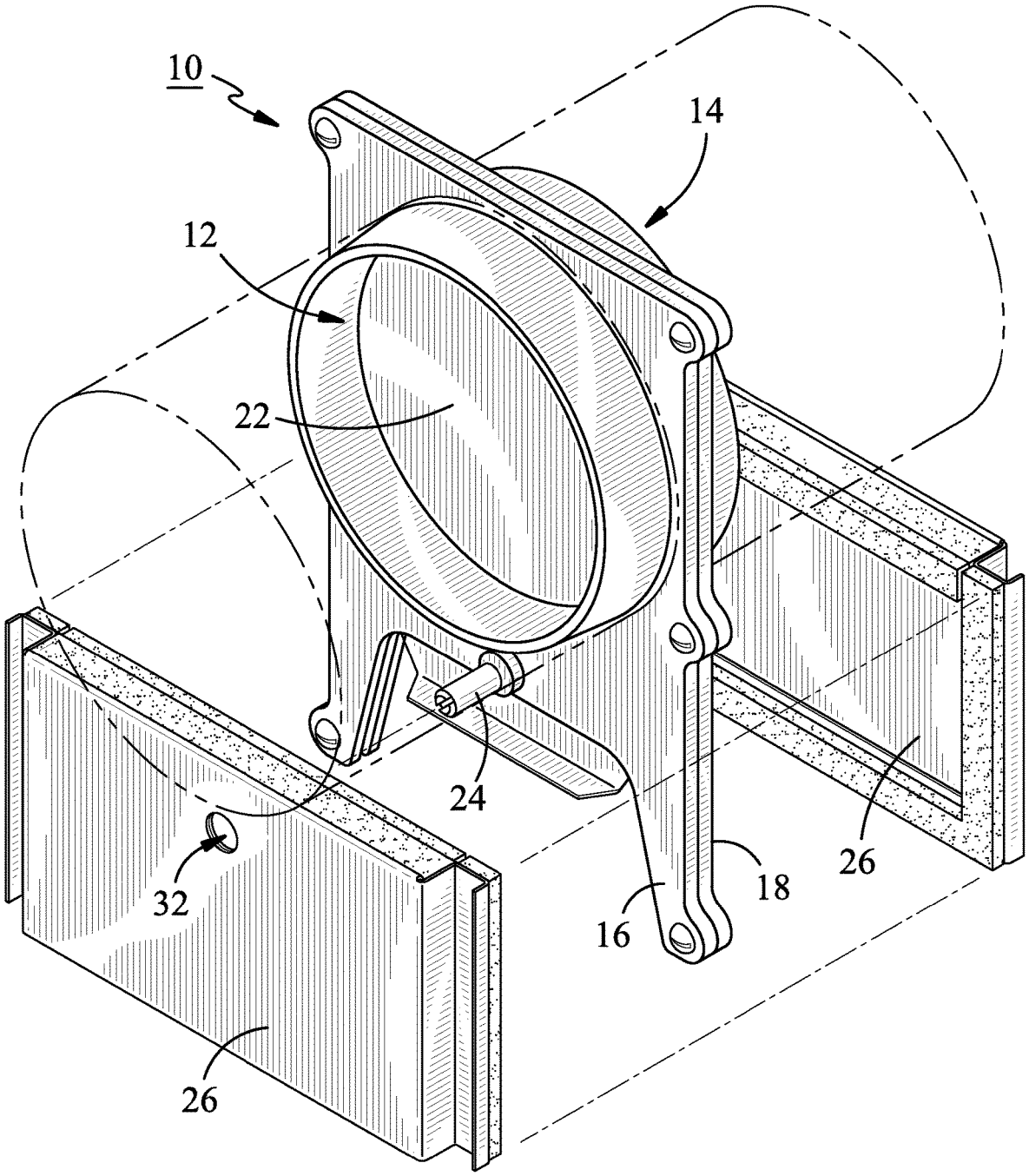
FIG. 11 is an exploded view of a blast gate having the relative positions of two cuff plates as used in the cuff of the present invention. The air ducts connected to the blast gate are shown in phantom.

Referring first to FIGS. 1-4 of the drawings, there is illustrated a conventional, prior art blast gate device generally designated by the numeral 10 having a housing with substantially cylindrical input and output ports, 12, 14 (FIG. 11) respectively. The ports 12, 14 are series connected in line with a section of an air duct system, shown in phantom, in FIG. 11. The blast gate housing has two back-to-back layers (plates) respectively, 16, 18, forming a slide mount having a cylindrical interior groove 20, in which a slider 22 is movably carried. The slider 22 is movable between open and closed positions, in the latter case functioning to shut off communication between the ports and interrupt the flow of air/gas. Depending on the application of the blast gate, the slider 22 can control any fractional part of the flow so as to affect either full or partial pressures, either upstream of the slider or downstream thereof. Effective channeling of the flow is thereby enabled. FIG. 1A shows the slider in a fully open position, whereas FIG. 1B shows the slider 22 in a closed position. The leading edge of the slider 22 in the closed position, occupies the groove 20. The outer (bottom) end of the slider 22 has a flange constituting a handle, for effecting its manual adjustment. The sides of the slider 22 occupy linear parts of the groove 20 during the slider's transitions. Dimple formations 23 in the slider 22 prevent it from being withdrawn past a certain point.

Although the locking mechanism (e.g., locking piece 24) is shown as a simple screw carried in a boss, other types of locks can be utilized, as can be readily understood. The locking function can be effected by establishing a frictional drag between the surface of the slider 22 with the adjacent undersurface of the gate housing 18.

The locking piece 24 acts on the slider 22 in such a way that the slider 22 is held in its desired position as a result of a force applied by the locking piece 24. The locking piece 24 can be threaded fastener that is tightened into contact with the slider 22 so as to bind the slider 22 in place. Alternatively, the locking piece 24 can be a spring loaded element that is naturally biased against the slider 22 for holding the slider 22 in place. To release the slider 22, the locking piece 24 is pulled out and the slider 22 can be adjusted and then when the locking piece 24 is released, it is biased back against the slider 22 to hold the slider in the adjusted position.

As noted in the preamble above, conventional blast gates of this type suffer from inadvertent pressure drops (or vacuum leaks, depending on the source of the air or gas flow). Such incidental flows lead to incomplete transfer capacity of heated or cooled air. This phenomenon arises because there is purposely designed a predetermined, overly loose fit between the slider 22 and the gate groove 20. This was made necessary in order to prevent potential problems in the field, resulting from unintentional binding during slider adjustments in the groove 20. Such binding could otherwise render an installation unworkable from a practical standpoint, and thus the dimensions of the gate groove 20 and slider 22 are such that even under adverse conditions, the looseness does not allow mechanical failure or inoperativeness of the gate in its intended application.

A gasket material is designated by the numeral 36, 38 in the figures and is described in more detail below.

The present invention addresses and overcomes the deficiencies associated with the conventional blast gate.

Referring now to FIGS. 11-15 and in accordance with the present invention, there is provided in combination with the blast gate and slider structures above noted, a novel and improved cuff 26 that reduces to substantially zero, inadvertent leakage of vacuum/supply air from the spaces in the vicinity of the gate groove 20 and slider 22.

It will be appreciated that the blast gate and cuff 26 of the present invention can be implemented in both a positive pressure environment in which air is being forced through a duct and through the blast gate and the cuff 26 serves to limit leakage of air to the surrounding atmosphere and conversely, when a vacuum is applied to the duct, the cuff 26 serves to prevent a vacuum leak in that air cannot be drawn into the gate from atmosphere.

The cuff 26 includes essentially two spaced apart expansive gasketed plates 28, 30 respectively, that are releasably secured in position over the slider 22 and groove 20, and held by slidable clips along opposite, sides of the slider. The plates are illustrated in FIGS. 6A and 6B and 5A and 5B, respectively. The plates 28, 30 also engage the plates 16, 18.

In order to provide clearance for the locking piece 24, one of the plates numbered 30 is provided with a clearance opening or hole 32, through which the locking piece 24 extends when the cuff 26 is finally positioned, and the blast gate is ready for resumption of operation. Aside from the clearance hole 32 in the one plate, the two plates 28, 30 can be substantially identical.

Further, in accomplishing the sealing function, the disclosed cuff 26 acts in the manner of a container cap which in effect forms a manually installable/removable chamber surrounding exposed parts of the slide mounting and slider. Sealing gasket material, preferably foamed rubber or plastic-like substance is provided, surrounding the periphery of the cuff. The gasket material is designated by the numeral 36, 38 in the figures.

Figure 1B:
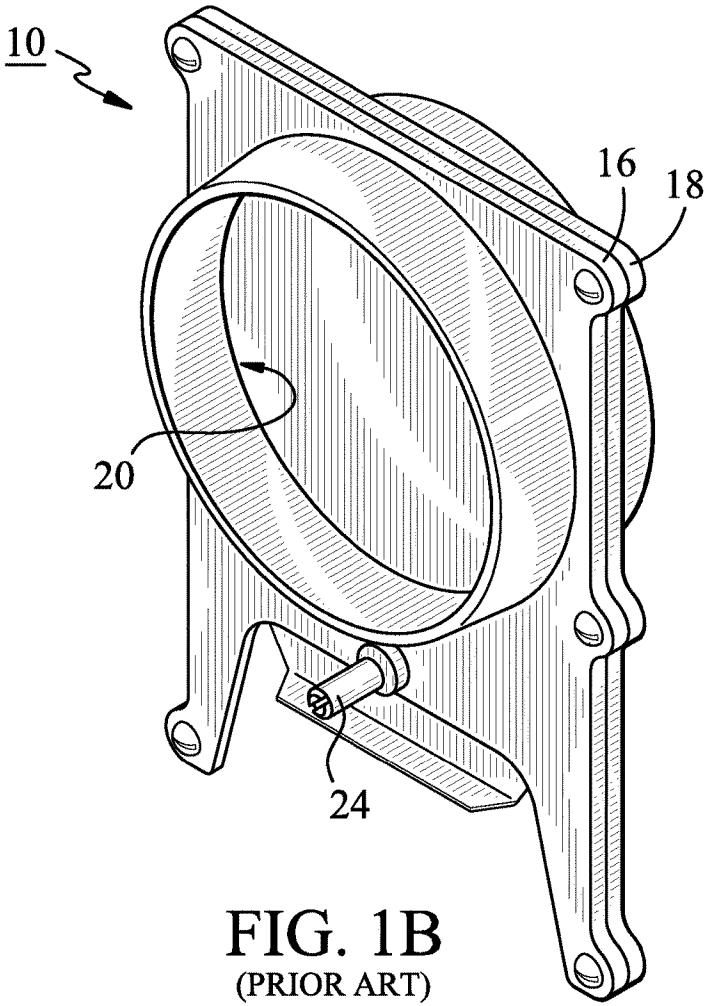
FIG. 1B (PRIOR ART)
FIG. 1B is a view like FIG. 1A, except showing the shutter in a fully closed position.
Figure 1A:
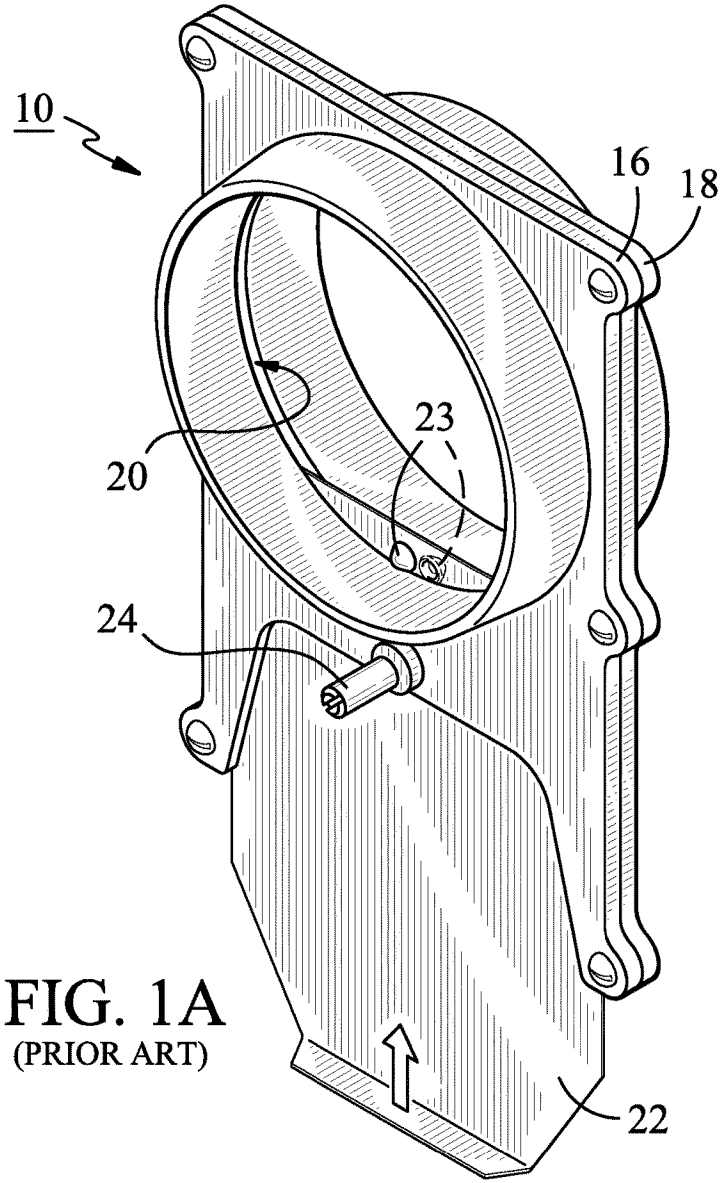
FIG. 1A (PRIOR ART)
FIG. 1A is a perspective view of a typical prior art blast gate of the type intended to be used with the present invention. The slider of the gate is shown in an open position, for substantially full volume air transfer between the opposed ports thereof.
Figure 2:
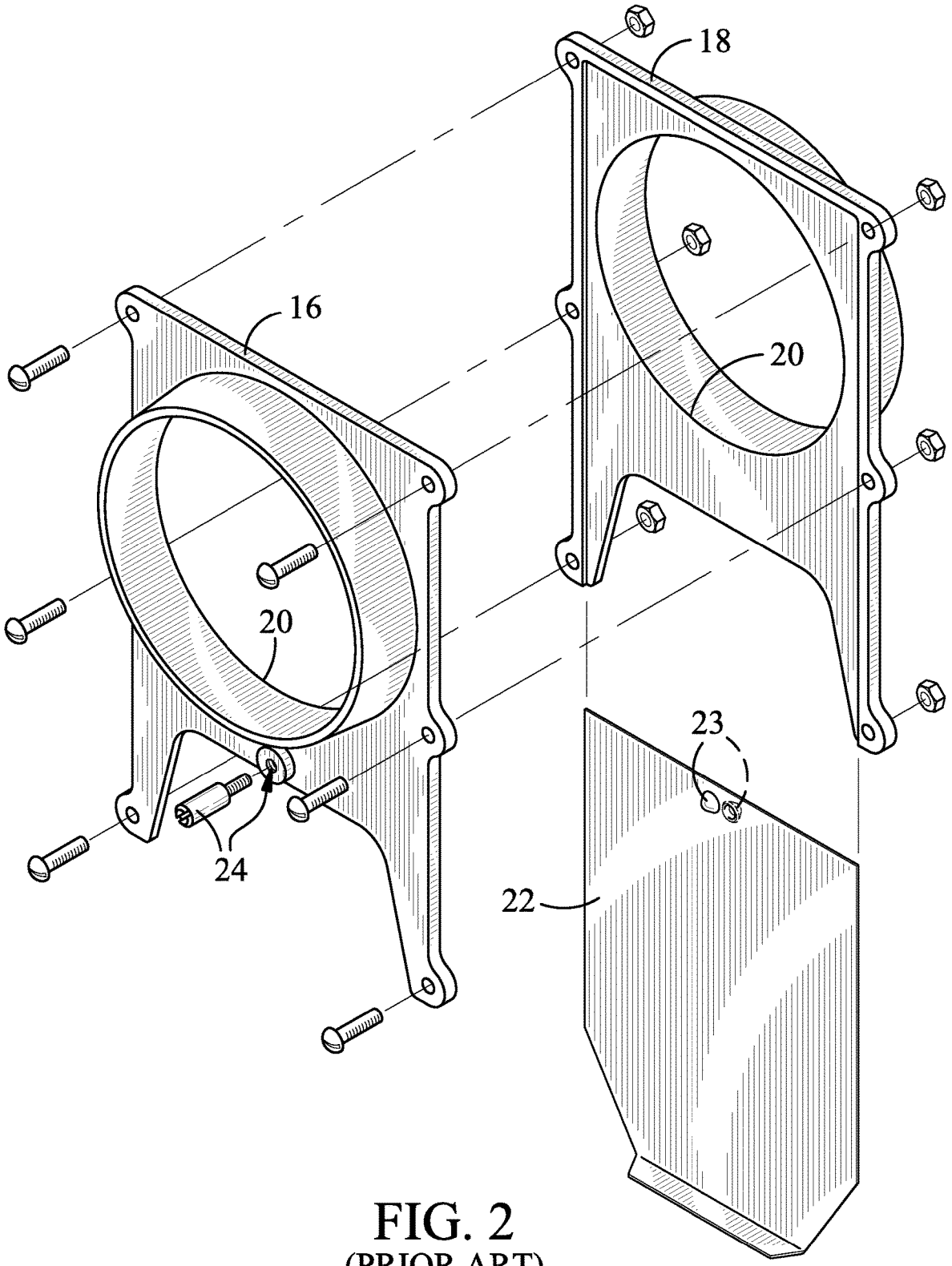
FIG. 2 (PRIOR ART)
FIG. 2 is an exploded view of the blast gate of FIGS. 1A and 1B.
Figure 3:
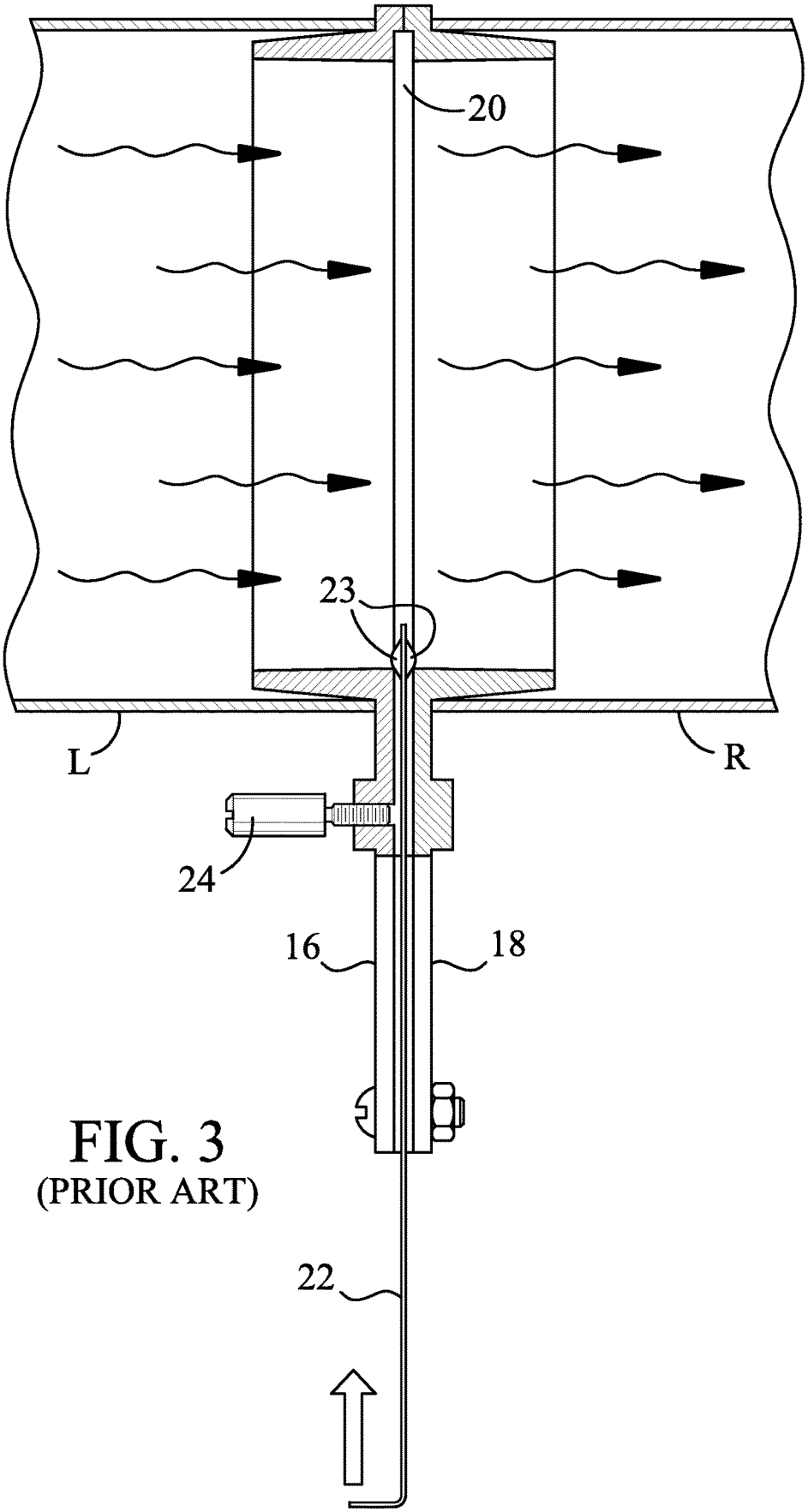
FIG. 3 (PRIOR ART)
FIG. 3 is a vertical section of a blast gate, showing the flow of pressurized gas from left to right in the figure, as indicated by the non-linear arrows.
Figure 4:
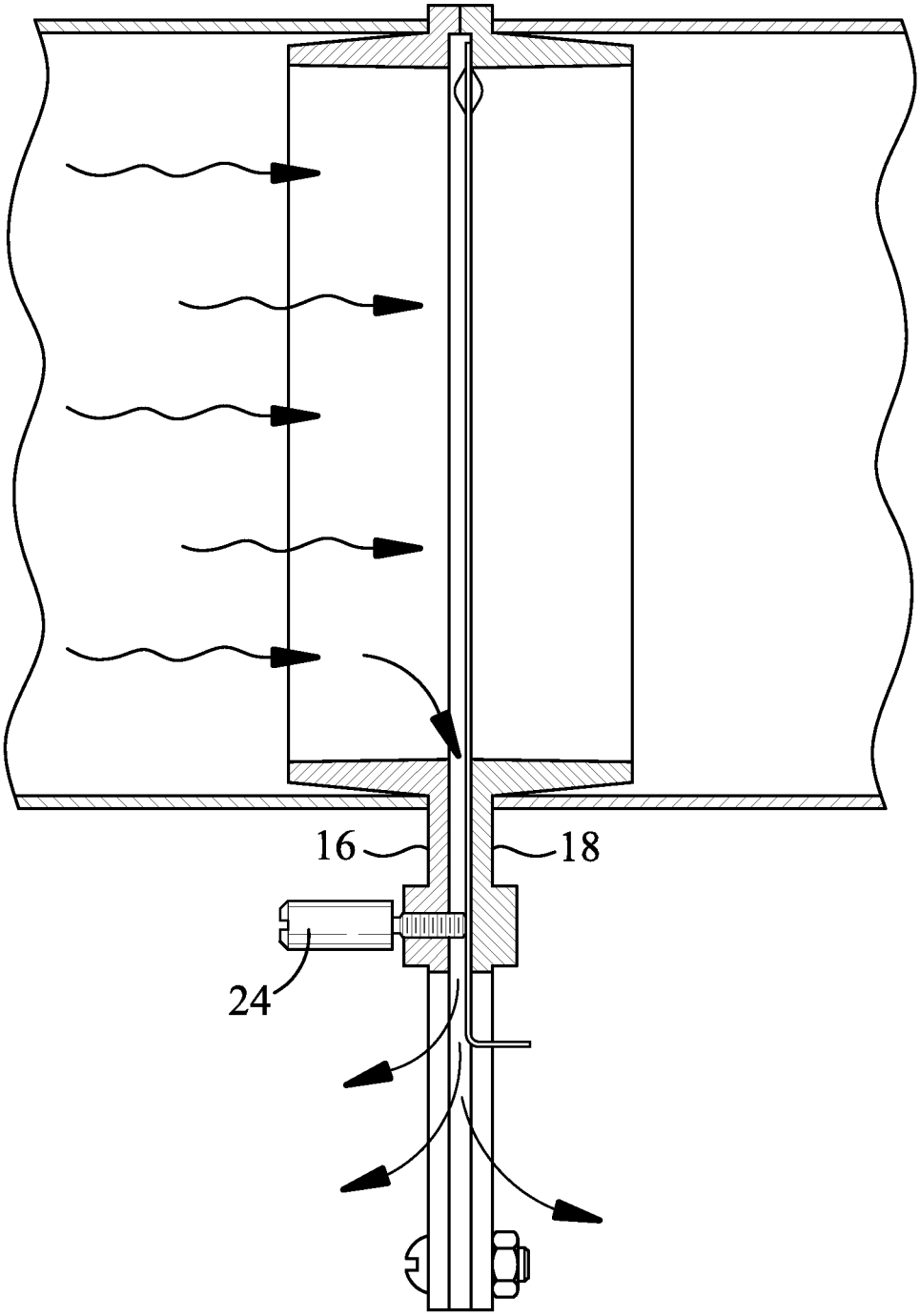
FIG. 4 (PRIOR ART)
FIG. 4 is a view like FIG. 3 and illustrating conventional flow along with leakage flow, the latter representing wasted heater or cooler capacity, respectively, that generates the flow (not shown).
Figure 5A:
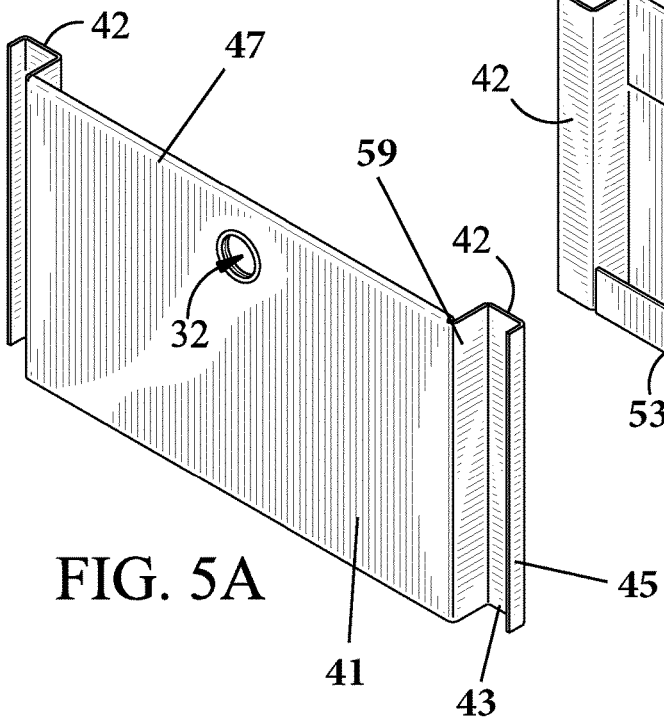
FIG. 5A is a perspective view of one of two plates utilized in the cuff of the present invention.
Figure 5B:
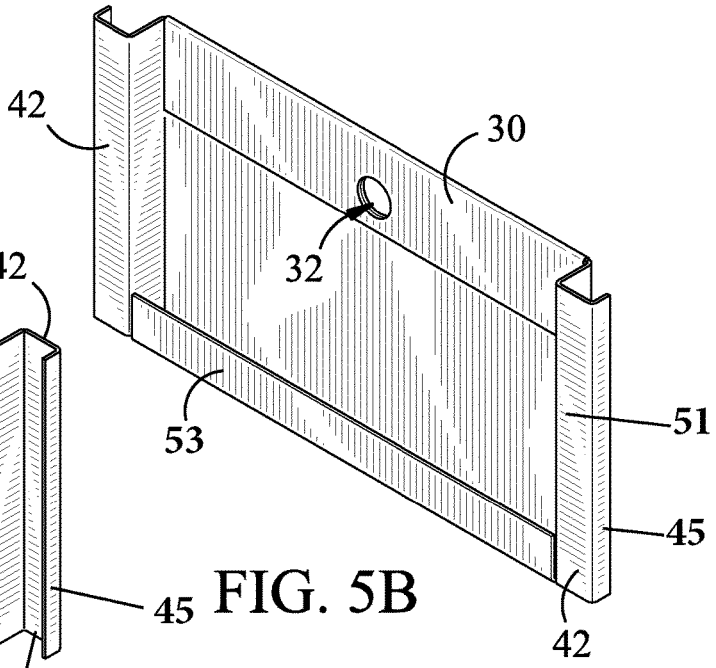
FIG. 5B is a perspective view of the plate side opposite that of FIG. 5A.
Figure 6A:
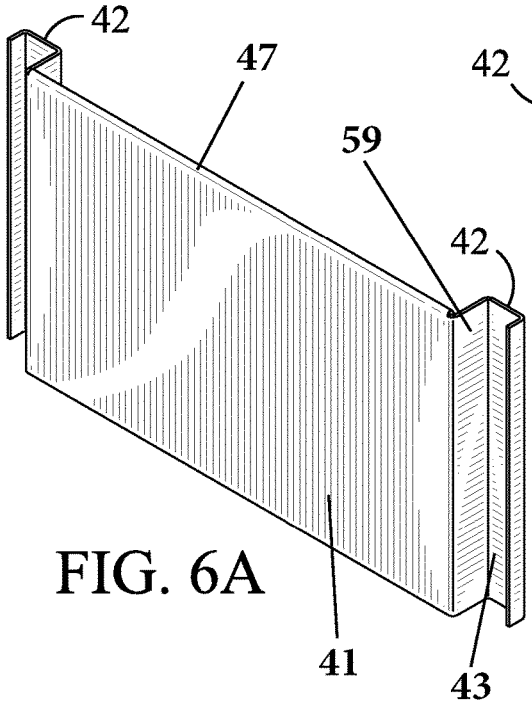
FIG. 6A is a perspective view of the other of two plates utilized in the cuff of the present invention.
Figure 6B:
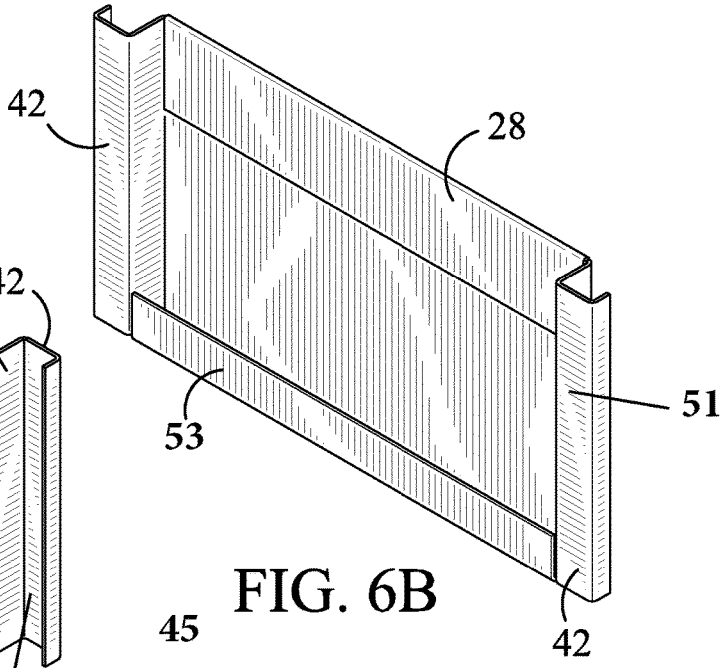
FIG. 6B is a perspective view of the plate side opposite that of FIG. 6A.
Figure 7A:
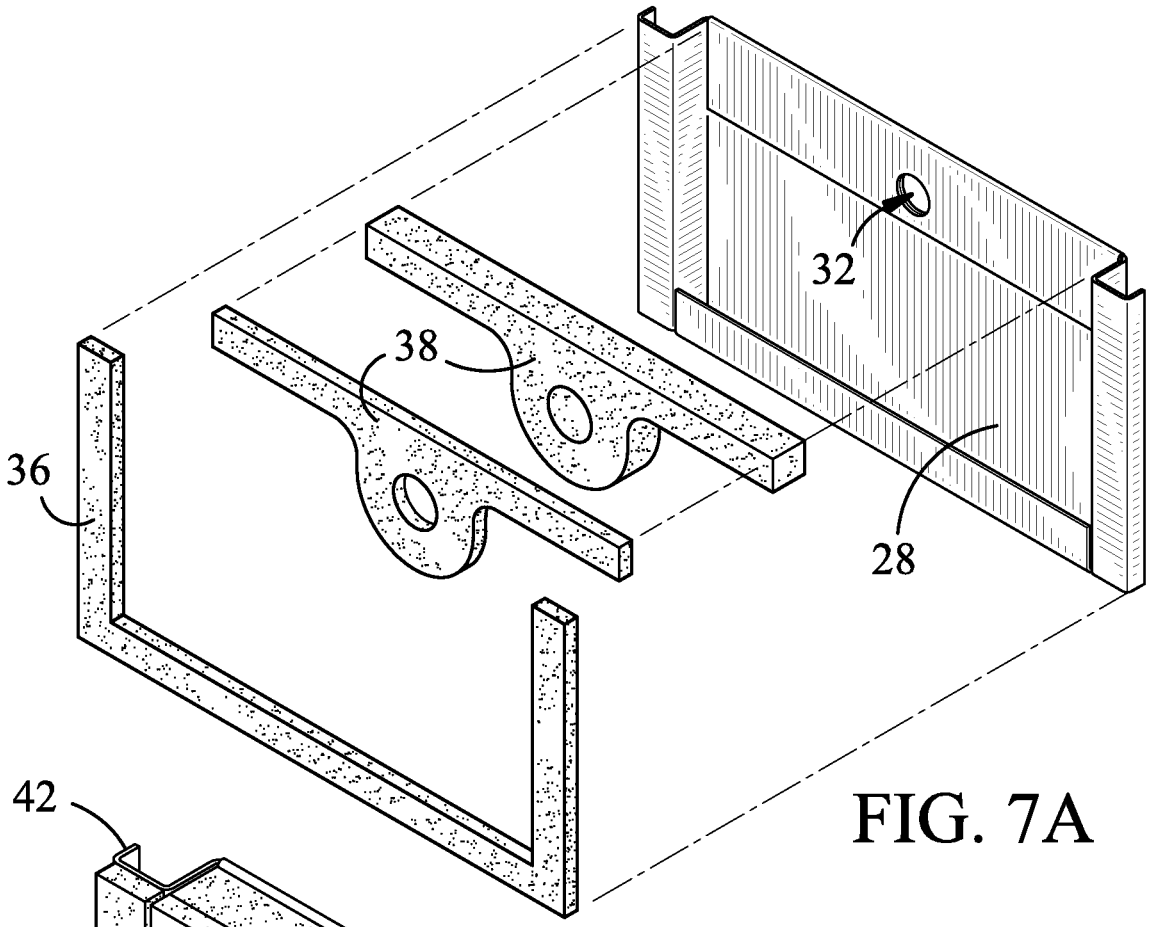
FIG. 7A is an exploded view of the plate of FIG. 5A and showing how gasket material is positioned in the plate of FIGS. 5A and 5B.
Figure 7B:
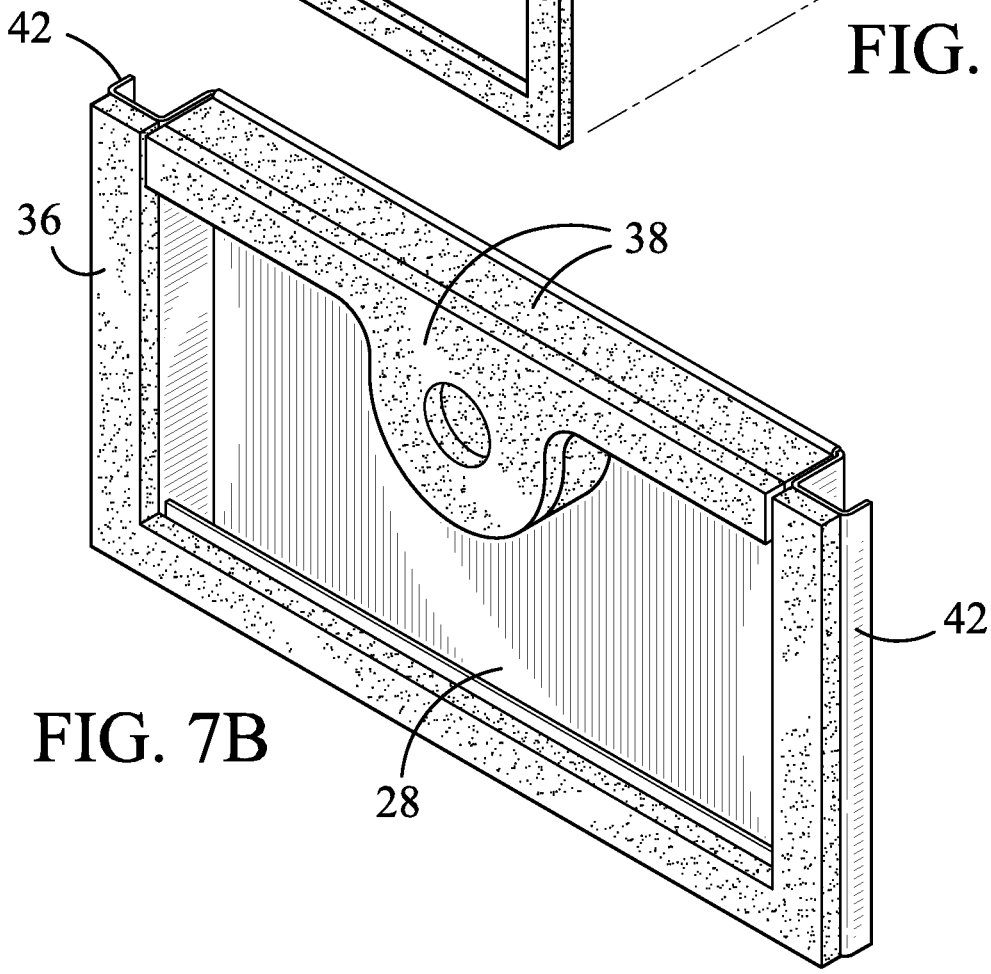
FIG. 7B is a perspective view of the plate and gasket material of FIG. 7A assembled.
Figure 8A:
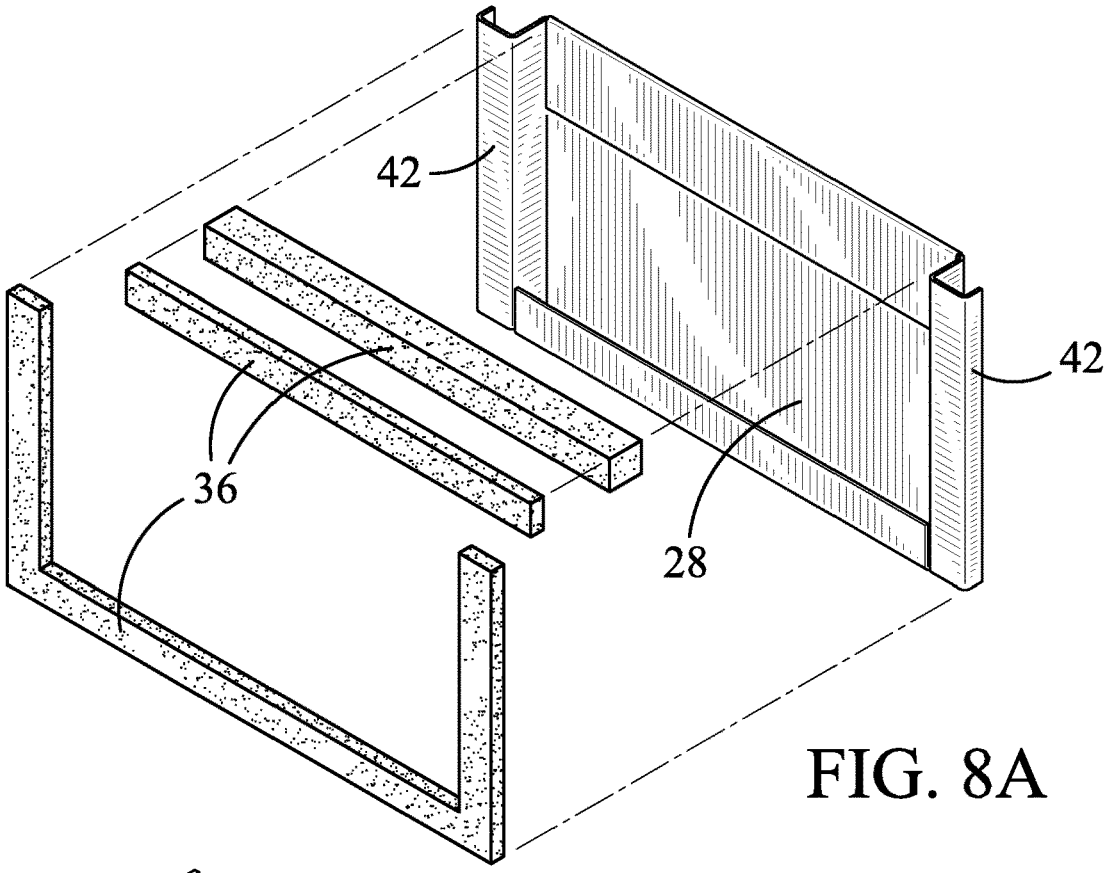
FIG. 8A is an exploded view of the plate of FIG. 6A and showing how gasket material is positioned in the plate of FIGS. 6A and 6B.
Figure 8B:
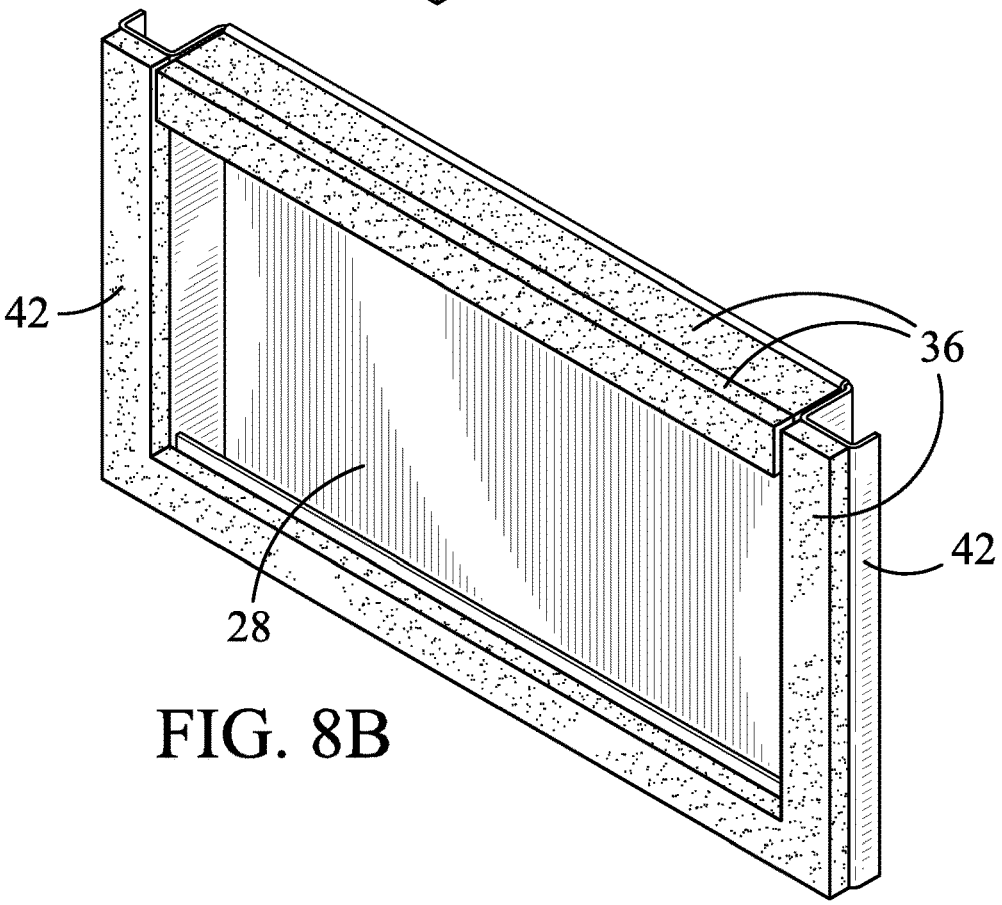
FIG. 8B is a perspective view of the plate and gasket material of FIG. 7A assembled.
Figure 9A:
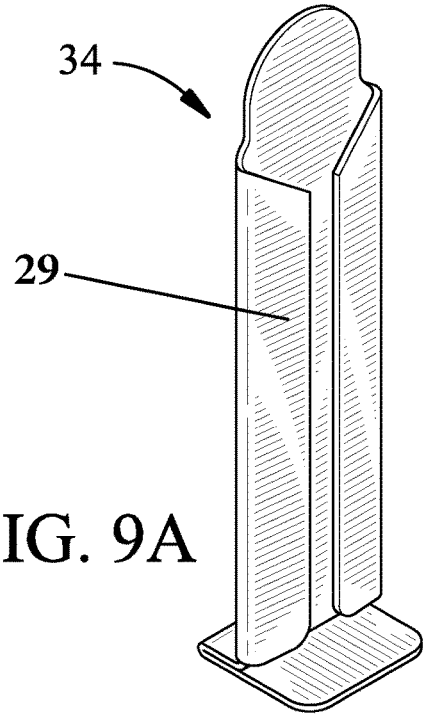
FIG. 9A is a perspective front view of one of two spring clips utilized to hold the plates of the cuff in position on a blast gate. The term spring clip as herein utilized is also referred to in the trade, as a drive cleat.
Figure 9B:
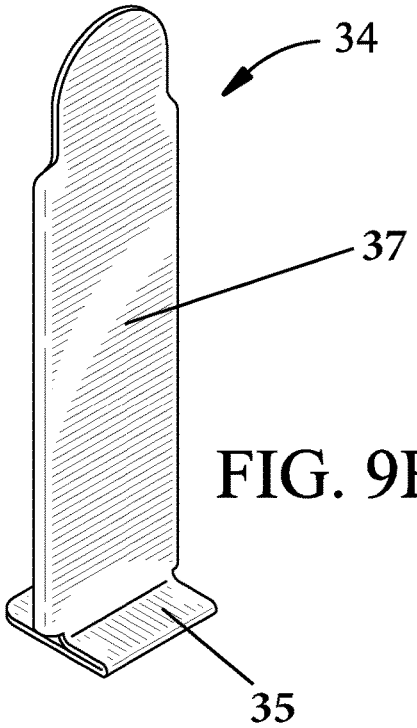
FIG. 9B is a perspective rear view of the spring clip of FIG. 9A.
Figure 10C:
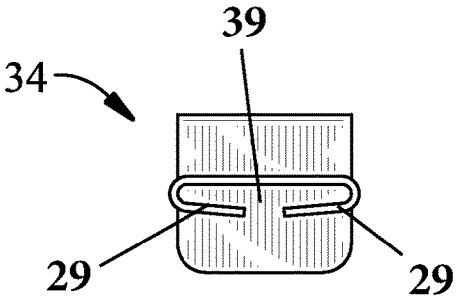
FIG. 10C is a top plan view of the spring clip of FIGS. 9A, 9B, 10A and 10B.
Figure 10A:
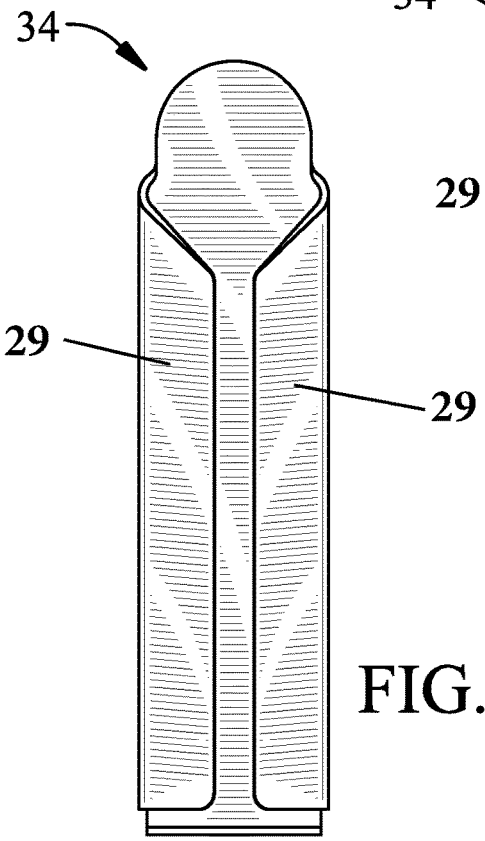
FIG. 10A is a front elevation of the spring clip of FIGS. 9A and 9B.
Figure 10B:
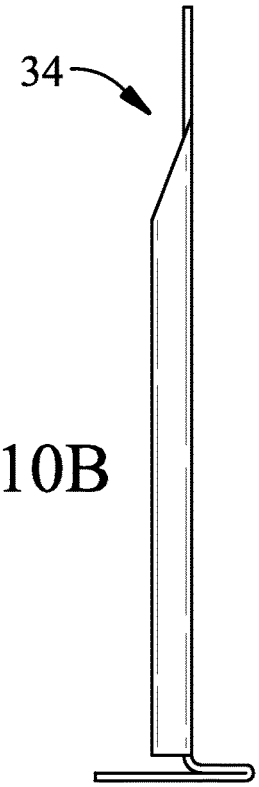
FIG. 10B is a right side elevation of the spring clip of FIGS. 9A, 9B, and 10A.

The gasket material 36, 38 is held in position on a series of angular peripheral formations 42 in the two plates 28, 30 of the cuff. Suitable cement or adhesive is used to bind the gasket material 36, 38 to the plates 28, 30. Layered gasket formations 38 are also utilized in connection with the plate 30 as shown in FIGS. 7A and 7B, to block off the area of the plate surrounding the locking piece 24, which protrudes from the slider 22. The finished cuff as applied onto the gate slide mounting as shown in FIGS. 7A, 7B, and 8A, 8B, respectively.

As shown, at each end of each plate 28, 30, the angular peripheral formation 42 is formed with a center section 47 of the plate 28, 30 being formed between the angular peripheral formations 42 at the two ends of the plate 28, 30. The center section 47 also has a side wall 41 and a bent bottom portion 49 that defines a bottom floor and a bottom lip 53 that extends upwardly from the floor and is parallel to the side wall 41 of the center section 47. The opening 32 is formed through the side wall 41.

The angular peripheral formation 42 is a bent end portion at each end of the plate 28, 30 and is generally U-shaped and is configured so that a U-shaped channel 43 is formed. The U-shaped channel 43 is defined by an outer flange (outer lip or outer edge) 45 and an inner side wall 59 that is parallel to the outer flange 45. The center section 47 is positioned outward of the U-shaped channels 43 when the plates 28, 30 are assembled. An inner (connecting) wall 51 of the U-shaped channel 43 is preferably parallel to the side wall 41 and the lip 53 of the bent bottom portion 49. Preferably, the lip 53 of the bent bottom portion 49 and the connecting walls 51 of each formation 42 lie at least substantially in the same plane. Each of the plates 28, 30 is open at this top end between the formations 42. In other words, unlike the bent bottom portion 49 which closes off the bottom of the plate 28, 30, there is no equivalent structure at the top of the plate 28, 30.

As a result of the closed bottoms of the plates 28, 30, when the two plates 28, 30 are placed into contact with one another as during the assembly process described below an open space (compartment) is formed between the plates 28, 30 and in particular, between the side walls 41 of the opposing plates 28, 30.

The gasket material is designated by the numeral 36, 38 in the figures and as shown in the figures, the gasket material is disposed along the inner surfaces of the plates 28, 30. With respect to the plate 28, a U-shaped piece of gasket material 36 is placed along the inner surfaces of the connecting walls 51 of the formations 42 and along the upstanding lip 53 of the bottom portion 49 since these structures are disposed in a common plane. The open space (compartment) of the plate 28 is located internally within this gasket material 36. To complete the gasket (seal), a piece 38 of gasket material is disposed along the inner surface of the side wall 41 between the two formations 42. The piece 38 can be thicker since the inner surfaces of the two pieces of gasket material 36, 38 preferably lie in at least substantially the same plane.

As shown in FIG. 7A, the plate 30 has a similar arrangement of gasket material except that the piece 38 must accommodate the opening 32 and therefore, the piece 38 can have a semi-circular section that has an opening formed therethrough for placement in alignment with the opening 32 to allow passage of the locking piece 24.

The gasket material can be in the form of foam or the like.

The gasket material can be attached to the plate surface using traditional techniques, such as use of an adhesive as mentioned herein.

Installation or removal of the cuff is readily made possible by two resilient spring clips 34. The details of the clips 34 are particularly illustrated in FIGS. 9A, 9B, 10A, 10B and 10C. While other means for connecting the plates 28, 30 is possible, the arrangement shown has been found to be the simplest and most economical arrangement for accomplishing the required quick assemble/removal retentions. As an example, within the scope of the invention, such other connecting means can include any of the following: self-tapping sheet metal screws, nuts and bolts, or rivnuts and bolts, and the aforementioned drive cleats.

Figure 12:
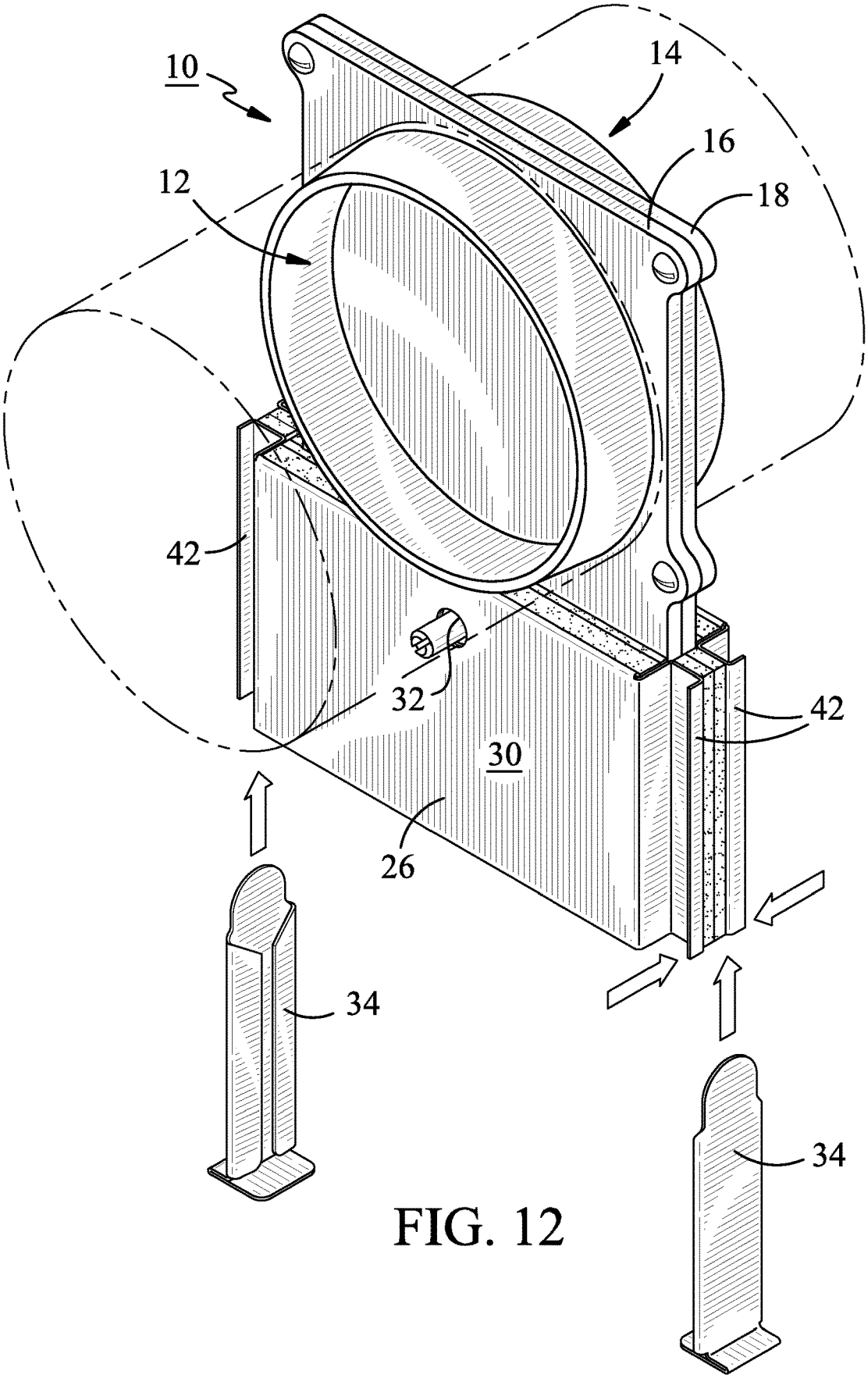
FIG. 12 is a perspective view of the blast gate of FIG. 11, and illustrating the installation of two spring clips of FIGS. 9A-10C on the accessory of the present invention.
Figure 13:
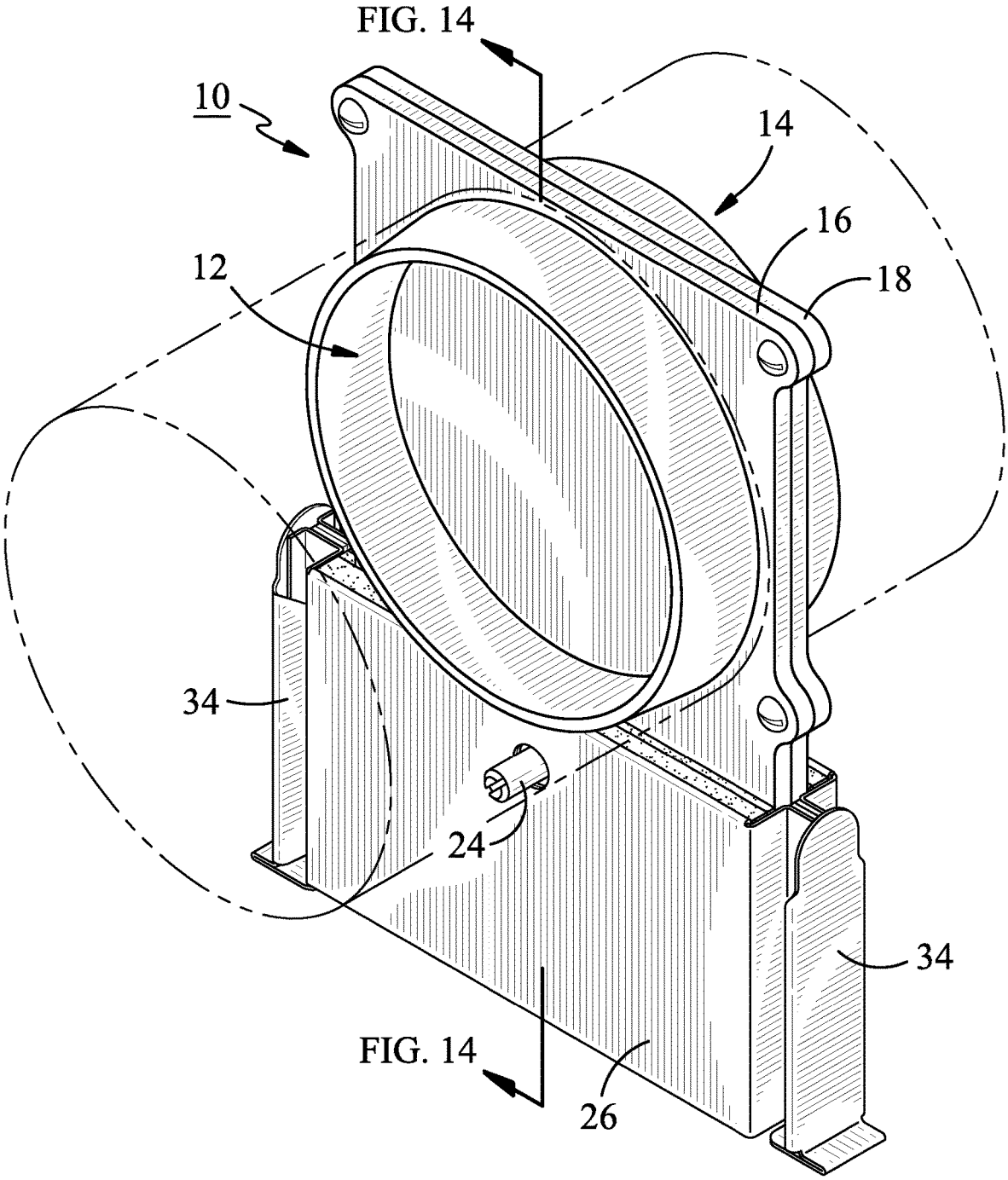
FIG. 13 is a view like FIG. 12, of the blast gate having the two springs fully installed on the accessory of the present invention.

The spring clip 34 has a base portion 35 and an upstanding structure 37 that is in the form of a split sleeve that has an outer wall and a pair of inner wall sections 29 with a slit formed between the two inner wall sections 29. Between the outer wall and the pair of inner wall sections 29 there is a channel 39 that receives the connecting walls 51 and the inner walls section 29. As best shown in FIG. 12, the spring clip 34 is designed such that the connecting walls 51 and the outer flanges 45 are received within the channel 39, thereby joining the two plates 28, 30 at each end of the plates 28, 30. The outer flanges 45 are located behind the front wall sections 29. By sliding the spring clips 34 onto the two plates 28, 30, the two plates 28, 30 are securely attached to one another and held in the desired position.

Figure 14:
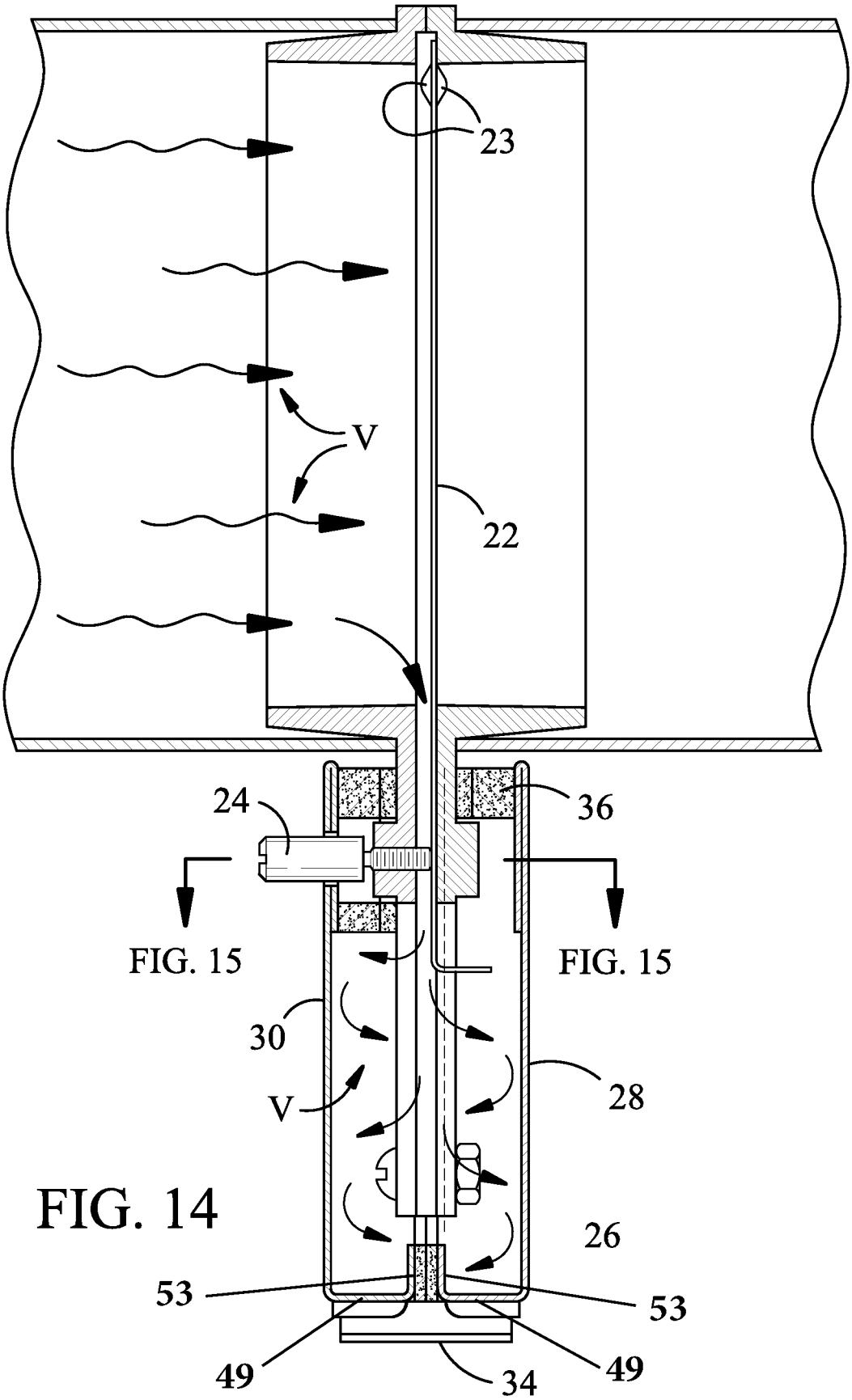
FIG. 14 is a section taken on the line 14-14 of FIG. 13.
Figure 15:
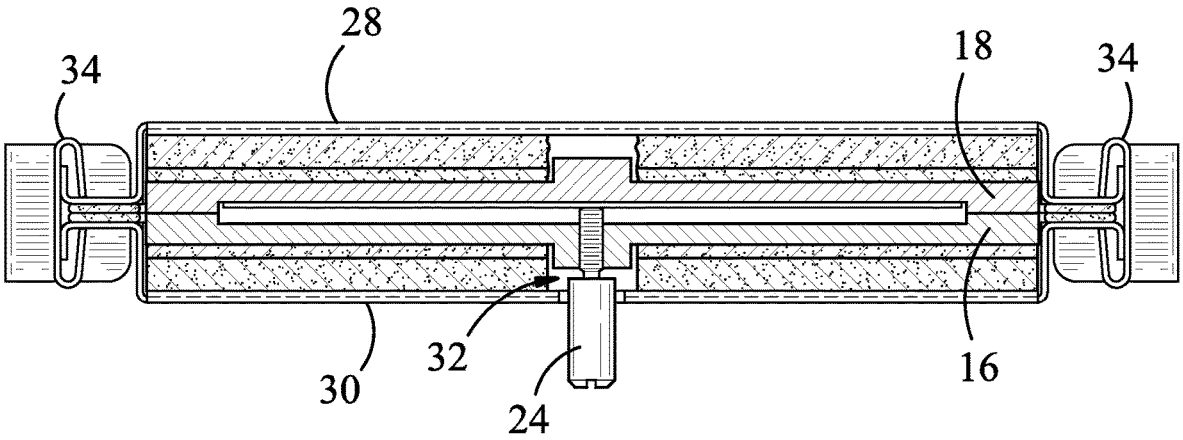
FIG. 15 is a horizontal section taken on the line 15-15 of FIG. 14.

As shown in the figures, the upper gasket piece 38 formed along the inner surface at the top of each of the plates 28, 30 seats against outer surfaces of the plates 16, 18. More specifically, the gasket material 38 and upper edges of the two legs of the U-shaped gasket material 36 seat against the plates 16, 18 at a location at and above the location of the locking piece 24. This sealing action seals the upper section of the cuff 26 against the blast gate. As mentioned herein, the bottom of the cuff 26 is sealed by the gasket material 36 that extends along the bent portion 49 and along the bottom end of the connecting wall 51. The gasket material 36 along the connecting walls 51 seals the sides of the cuff 26. In this way, a sealed compartment is formed within the cuff 26 between the plates 28, 30. As shown in FIG. 14, the slider 22 can be fully isolated and contained within this sealed interior compartment of the cuff 26. However, in other implementations, the slider 22 can at least partially extend outside of the assembled cuff 26 while still maintain the sealed interior compartment of the cuff 26. For example, the bent bottom edge of the slider 22 can be eliminated and the slider can extend between the gasket materials 36 of the two cuff plates 28, 30. In this orientation, the slider 22 can be adjusted even with the cuff 26 installed in place since a bottom of the slider 22 is located below the cuff 26.

As shown, the plates 16, 18 can include openings, such as in the corners, that receive fasteners (e.g., bolts) for attaching the plates 16, 18 to one another.

FIG. 14 particularly illustrates the action of the cuff 26 in position, with arrows "V" showing the path taken by a pressurized air stream approaching the blast gate (as by flowing through a duct). That air which would normally be lost is illustrated by the multiple arrows inside the cuff 26, and rather than being released, the air merely collects in the cuff (within the interior compartment of the cuff) and converts into harmless, completely confined circulation currents. With this arrangement, little or no air is allowed to escape (or be drawn into a gate that is under negative pressure as when a vacuum is applied to the duct), and the object of reduction in leakage surrounding the blast gate is thereby accomplished. This is an advantage over the air loss associated with the traditional blast gate construction shown in FIG. 4.

It will be appreciated that the cuff 26 is held by a friction fit on the blast gate using the spring clips 34 and also the plate 30 is hung on the locking piece 24. In combination, the cuff 26 is retained on the plates 16, 18 of the blast gate.

The plates 28, 30 can be formed of metal or plastic or other suitable material and likewise, the spring clips 34 can be formed of plastic or metal, etc.

It is noted that the disclosed arrangement is completely portable, and installation on an existing gate is greatly simplified.

The one cuff as shown is capable of being utilized with other gates having similar dimensions, thereby reducing the quantity of equipment required when designing a system of multiple integrated air ducts.

From the above it can be seen that we have provided a novel and improved blast gate leakage control cuff which is both simple in its structure and reliable in use. Adjustments of the position of the slider in the blast gate is also facilitated, due to the quick 'connect and disconnect' character of the present invention.

The present invention may be embodied in other specific forms without departing from the spirit of any of the essential attributes thereof.

Therefore, the illustrated embodiments should be considered in all respects as illustrative and not restrictive, reference being made to the appended claim(s) and to the foregoing description, to indicate the scope of the invention.

Variations and modifications are possible without departing from the spirit of the invention.

What is claimed is:

1. A leak-resistant accessory for use with a blast gate device having a blast gate housing with substantially cylindrical input and output ports, said ports being adapted to be series connected in line with a section of an air duct system, said blast gate housing comprising a pair of inner plates that define a slide mount having an internal peripheral groove in which a slider is movably carried between the ports, said accessory comprising in combination:

an exterior cuff comprising a pair of coextensive outer plates overlying opposite faces respectively, of the blast housing's slide mount, each outer plate having a pair of angular peripheral formations with a center section defined therebetween, wherein each of the outer plates is configured such that when assembled to the slide mount, open air spaces are formed between the center sections of the outer plates and the inner plates as a result of the center sections of the outer plates being spaced from the inner plates, the angular peripheral formations of the outer plates being coupled to one another along peripheral edges of the inner plates, resilient, compressible gasket material disposed between peripheral and central portions of said plates, said gasket material forming a substantially air-tight seal between the slider and slide mount of the cuff and the exterior of the cuff, and a manually operable adjustment for exerting binding force between said slider and said coextensive plates, whereby relative inadvertent movement of the slider inside the cuff is prevented.

2. An exterior cuff for use with a blast gate device having a blast gate housing with input and output ports that are configured to be series connected in line with a section of an air duct system, the cuff comprising:

a first plate having a center section and a pair of bent end sections, each bent end section having an inner side wall, an outer flange, and a connecting wall connecting the outer flange to the inner side wall, the first plate having a first inner contact face defined by the connecting walls and an upturned bottom lip of a bottom bent portion of the center section, the center section having an opening formed therein;

a second plate having a center section and a pair of bent end sections, each bent end section having an inner side wall, an outer flange, and a connecting wall connecting the outer flange to the inner side wall, the first plate having a second inner contact face defined by the connecting walls and an upturned bottom lip of a bottom bent portion of the center section;

resilient, compressible gasket material that is formed along each of the first inner contact face and the second contact face and is disposed between the inner side walls of each of the first plate and the second plate, wherein the gasket material of the first inner contact face and the second contact face seat against one another to provide a substantially air tight seal therebetween and defining an inner chamber for receiving a portion of the blast gate housing; and a pair of spring clips that slide over the bent end sections for maintaining the first and second plates in an abutting orientation.

3. The cuff of claim 2, wherein the connecting walls and the upturned bottom lip of each of the first plate and the second plate lie in at least substantially the same plane.

4. The cuff of claim 2, wherein the inner side wall and the outer flange of each bent end section of each of the first plate and the second plate are parallel to one another.

5. The cuff of claim 2, wherein gasket material comprises a first piece that is U-shaped and extends along the connecting walls and bottom lip of each of the first plate and the second plate and a second piece that is disposed along a top edge of the center section between the inner side walls of the bent end sections.

6. The cuff of claim 2, wherein the second piece is thicker than the first piece.

7. The cuff of claim 2, wherein the second piece includes a through hole that aligns with the opening formed in the center section of the first plate.

8. The cuff of claim 2, wherein the second piece for the first plate includes a linear portion and an extension that extends outwardly from the linear portion with the through hole being formed in the extension.

9. The cuff of claim 2, wherein the gasket material comprises foam.

10. The cuff of claim 2, wherein the second piece comprises a layered structure.

11. The cuff of claim 2, wherein each spring clip has a base portion and an upstanding portion that has an outer wall and two inner walls with a main channel formed between the outer wall and the two inner walls and a slit is formed between the two inner walls.

12. The cuff of claim 11, wherein the connecting walls are disposed in the slits of the spring clips and the outer flanges are disposed in the main channels of the spring clips.

* * * * *